US005352557A

United States Patent [19]

Matsuoka et al.

[11] Patent Number: 5,352,557

[45] Date of Patent: Oct. 4, 1994

[54] LIQUID DEVELOPER FOR ELECTROSTATIC PHOTOGRAPHY

[75] Inventors: Hirotaka Matsuoka; Takako Kobayashi; Ken Hashimoto, all of Minamiashigara, Japan

[73] Assignee: Fuji Xerox Co., Ltd., Tokyo, Japan

[21] Appl. No.: 136,757

[22] Filed: Oct. 15, 1993

[30] Foreign Application Priority Data

Dec. 11, 1992 [JP] Japan ..... 4-352375

[51] Int. Cl.[5] ..... G03G 9/125

[52] U.S. Cl. ..... 430/116

[58] Field of Search ..... 430/112, 116

[56] References Cited

U.S. PATENT DOCUMENTS

| | | | |
|---|---|---|---|
| 3,264,272 | 8/1966 | Rees . | |
| 3,907,694 | 9/1975 | Lu | 430/116 X |
| 4,026,713 | 5/1977 | Sambucetti et al. | 430/116 X |
| 4,664,841 | 5/1987 | Kitahara et al. | 430/116 X |
| 4,794,651 | 12/1988 | Landa et al. | 430/110 |

FOREIGN PATENT DOCUMENTS

| | | | |
|---|---|---|---|
| 35-5511 | 10/1957 | Japan . | |
| 36-14872 | 4/1959 | Japan . | |
| 38-22343 | 10/1963 | Japan . | |
| 40-19186 | 8/1965 | Japan . | |
| 43-13519 | 6/1968 | Japan . | |
| 45-14545 | 5/1970 | Japan . | |
| 51-89428 | 8/1976 | Japan . | |
| 56-9189 | 2/1981 | Japan . | |
| 58-2851 | 1/1983 | Japan . | |
| 58-129438 | 8/1983 | Japan . | |
| 58-152258 | 9/1983 | Japan . | |
| 2-6965 | 1/1990 | Japan . | |
| 4-208963 | 7/1992 | Japan . | |
| 457065 | 3/1975 | U.S.S.R. | 430/116 |

OTHER PUBLICATIONS

K. A. Metcalfe: *Journal of Scientific Instruments;* "Laboratory and Workshop Notes"; Aug. 30, 1954; pp. 74–75.

K. A. Metcalfe et al.; *Journal of Scientific Instruments;* "Fine Grain Development in Xerography"; Jul. 19, 1955; pp. 194–195.

*Primary Examiner*—Roland Martin

*Attorney, Agent, or Firm*—Oliff & Berridge

[57] ABSTRACT

A liquid developer for use in electrostatic photography comprises toner particles, each containing a resin and a colorant dispersed in a carrier liquid. The carrier liquid comprises at least one ether compound derived from ethylene glycol or propylene group and represented by the following general formula $$R_1—O(C_nH_{2n}O)_xR_2$$

wherein $R_1$ and $R_2$ may be the same or different and represent an alkyl group or an aryl group, n is an integer of 2 or 3, and x is an integer of 1 to 3. The ether compound is present in the carrier liquid in the range of from 5 to 100 wt %.

6 Claims, 1 Drawing Sheet

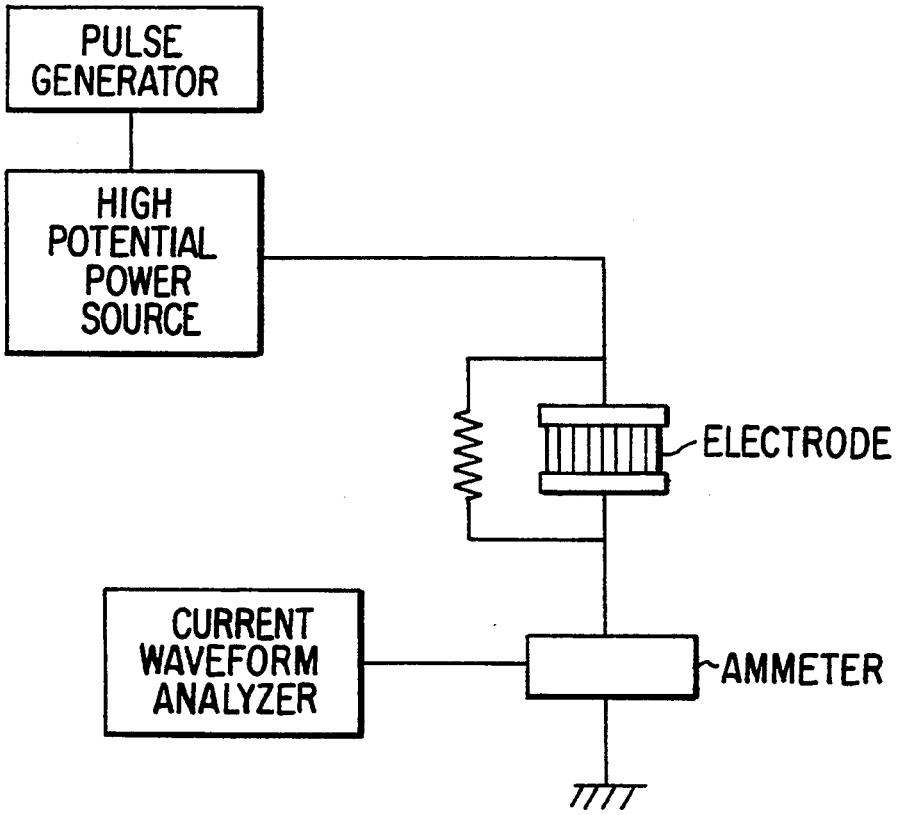
PULSE GENERATOR
HIGH POTENTIAL POWER SOURCE
ELECTRODE
CURRENT WAVEFORM ANALYZER
AMMETER

LIQUID DEVELOPER FOR ELECTROSTATIC PHOTOGRAPHY

BACKGROUND OF THE INVENTION

1. Field of The Invention

This invention relates to a liquid developer for electrostatic photography wherein ether compounds are used as a carrier liquid.

2. Description of The Prior Art

The wet developing system in electrophotography is generally carried out by a process which comprises subjecting a photosensitive material to charging and imagewise exposure to form an electrostatic latent image thereon, developing the electrostatic latent image with a liquid developer which consists of a dispersion of toner particles mainly composed of a resin and a colorant in aliphatic hydrocarbons, transferring the resulting toner image onto a transfer paper sheet, and fixing the image to form a final image.

If a photosensitive paper or film having a photoconductive material, such as zinc oxide, coated thereon is used in the above process, it is possible to omit the transfer step and to directly fix the toner image on the photosensitive material after the development. In addition, the wet development is often used as a developing means such as of electrostatic recording systems wherein an electrostatic latent image is formed on a dielectric material through electric inputting without use of any photosensitive material.

In the wet developing systems, a fine particle toner having a size of from sub-microns to several microns is dispersed, as set forth above, in a carrier liquid having a high electric resistivity, such as aliphatic hydrocarbons. The development of a latent image is based mainly on the electrophoretic principle. This eventually leads to the fact that images with a higher resolution than in dry developing systems making use of toner particles with a size of not smaller than several microns are likely to obtain.

In the two references which Metcalfe reported at his initial stage, i.e. (K. A. Metcalfe, J. Sci. Instrum., 32, 74 (1955) and ibid., 33, 194 (1956), it is stated that a great number of organic or inorganic pigments including carbon black, magnesium oxide and the like are usable as pigments of liquid developers and gasoline, kerosine, carbon tetrachloride and the like are usable as a carrier liquid.

In Japanese Patent Publications issued at the time corresponding to the early stage of Metcalfe, there are stated the use of halogenated hydrocarbons as the carrier liquid (Japanese Patent Publication No. 35-5511), and the use of polysiloxanes (Japanese Patent Publication No. 36-14872) and ligroin and mixtures of these petroleum hydrocarbons (Japanese Patent Publication Nos. 38-22343 and 43-13519).

Among patent publications which are directed to processes of making toners, there are a number of patent publications which deal with carrier liquids. Typical examples include Japanese Patent Publication Nos. 40-19186, 45-14545 and 56-9189. The carrier liquids (which may also serve as a dispersion medium at the time of polymerization) set forth in these publications include aromatic hydrocarbons such as benzene, toluene, xylene and the like, esters, alcohols, and aliphatic hydrocarbons such as n-hexane, i-dodecane, Isoper H, G, L and V (Ekson Chem. Co., Ltd.)

However, the hitherto proposed carrier liquids are mostly composed of organic solvents whose vapor pressure is high. This leads to the following problems: i) the vapor of carrier liquids discharged at the time of fixing is liable to cause environmental pollution; and ii) the vapor is very likely to cause ignition.

To cope with the above problems, it may occur that in order to lower the vapor pressure of carrier liquids, petroleum solvents such as low vapor pressure hydrocarbons are used as the carrier liquid. If the molecular weight of hydrocarbons is increased so that the vapor pressure is lowered, the carrier liquid using such hydrocarbons is increased in viscosity, thus adversely influencing the developing speed. Moreover, since the melting point of the carrier liquid increases to the neighbourhood of room temperature, it becomes necessary to invariably heat the carrier liquid for use as a liquid developer. This is unfavorable from the standpoint of energy saving, thermal pollution and deterioration of the liquid developer.

In Japanese Laid-open Patent Application No. 51-89428, there has been proposed the use, as the carrier liquid, of hydrocarbon solutions which have an electric resistivity of not lower than $10^9$ Ω·cm and a dielectric constant of not higher than 3.0. Hitherto proposed carrier liquids are predominantly composed of non-polar hydrocarbon solutions which have a high electric resistivity and a low dielectric constant. It is empirically known that if the electric resistivity of the carrier liquid is lower than an appropriate level, a latent image on a photosensitive material may be broken, or a bias leakage at the developing and transfer units may take place, not resulting in images of good quality.

The liquid developers which contain non-polar carrier liquids having high electric resistivity and low dielectric constant are not always satisfactory with respect to the chargeability to toner and its stability in relation to time. More particularly, there arise the problems that the charge quantity of toner is reduced as time passes and that the quantity of a reverse polarity toner is increased.

Thus, there have never been obtained any carrier liquids which are satisfactory for use in hitherto proposed liquid developers.

SUMMARY OF THE INVENTION

It is accordingly an object of the invention to provide a liquid developer which overcomes the above-stated problems or disadvantages and which enables one to reduce the amount of a carrier liquid to be discharged from copying machines or printers making use of the liquid developer.

It is another object of the invention to provide a liquid developer making use of a liquid carrier which is unlikely to suffer the danger of fire and which has good charge characteristics and charge stability.

It is a further object of the invention to provide a liquid developer whose carrier liquid is made of glycol diethers derived from ethylene glycol or propylene glycol whereby the carrier liquid has appropriate insulating properties, viscosity, solubility of a binder for toner, and low flow point.

In order to obtain a liquid developer which ensures reduction in amount of a carrier liquid being discharged during the course of development and is thus substantially free of any ecological problem involved in the discharge, we have intensively studied carrier liquids. As a result, it has been found that when used as a carrier liquid, glycol diethers which are derived from ethylene glycol, propylene glycol, diethylene glycol, dipropylene glycol and the like have a low viscosity approximately equal to that of known carrier liquids and that the vapor of the carrier being generated can be significantly reduced in amount. In addition, the glycol diethers exhibit better charge characteristics and stability than known carrier liquids.

According to the invention, there is provided a liquid developer for use in electrostatic photography which comprises toner particles, each containing a resin and a colorant dispersed in a carrier liquid, the carrier liquid comprising at least one ether compound of the following general formula $$R_1—O(C_nH_{2n}O)_x—R_2$$

wherein R1 and R2 may be the same or different and represent an alkyl group or an aryl group, n is an integer of 2 or 3, and x is an integer of 1 to 3.

BRIEF DESCRIPTION OF THE DRAWING

The sole figure is a circuit diagram of a toner charge measuring device for measuring an amount of a toner in liquid developers obtained in Examples 1 to 7.

DETAILED DESCRIPTION AND EMBODIMENTS OF THE INVENTION

In the liquid developer for electrostatic photography of the invention, the carrier liquid used to disperse toner particles made of resins and colorants therein is an ether compound of the above-indicated general formula. In the formula, the alkyl group represented by $R_1$ and $R_2$ may be a linear or branched alkyl group such as methyl, ethyl, propyl, butyl, pentyl, hexyl, heptyl, octyl, nonyl, decyl or the like, and a cycloalkyl group such as cyclopentyl, cyclohexyl or the like. The aryl group may be substituted or unsubstituted and includes, for example, an aryl group such as phenyl, tolyl, xylyl, naphthyl or the like, and an arylalkyl group such as benzyl, phenethyl or the like.

These ether compounds have insulating properties, a viscosity, the solubility of a toner binder and a flow point, which are suitable for use as a carrier liquid of liquid developers. In addition, they are much lower in vapor pressure than known carrier liquids and is odorless. The reason for this is considered to result from the number of ether polar groups in the molecule chain (i.e. $x+1$ in the above formula) and the lengths of the hydrophobic groups $R_1$ and $R_2$ at both ends.

The lengths of the hydrophobic groups are considered (i) to mitigate the interaction between polar groups, such as hydrogen bond, thereby lowering the viscosity of the carrier liquid, (ii) to raise the electric resistivity to an empirically usable extent, (iii) to increase affinity, for example, for olefinic binder resins, and (iv) to have interrelation with a vapor pressure within a certain range of the length.

To this end, it is preferred to use one or more of ether compounds which have the total of carbon atoms of from 6 to 20 in the alkyl and/or aryl groups represented by $R_1$ and $R_2$. If the total carbon atoms in $R_1$ and $R_2$ are smaller in number than 6, the electric resistivity increased in excess and the solubility of olefinic binder resins is undesirably lowered. In addition, the vapor pressure may increase in excess. On the other hand, when the total of the carbon atoms exceeds 20, the viscosity of the resultant carrier liquid becomes higher than in a desired range, causing the developing speed of toner based on the electrophoretic force to be lowered.

The number of the ether polar groups or the polar groups in the molecule is considered to influence the freezing point and the charge-imparting characteristic to toner. For instance, while linear hydrocarbons having a molecular weight substantially equal to that of the ether compounds of the invention are increased in freezing point up to the neighbourhood of room temperature as the molecular weight increases, the ether compounds have a remarkably lowered freezing point. Thus, the ether compounds satisfactorily function as a carrier liquid under environments of winter.

The toner charge-imparting function is also improved over that of hydrocarbons having a similar molecular weight: i) the charge exchangeability between the toner and the carrier liquid is more promoted or stabilized; and ii) where a charge control agent such as a so-called charge director, is added, its dispersability and solubility can be appropriately controlled, thereby improving the charge stability of the developer.

These specific characteristic features are considered to develop owing to the fact that since the ether compound has polar ether groups in the molecule chain, they can impart polarity to the carrier liquid. In this connection, the optimum number of glycol units in the molecule chain is in the range of from 1 to 3. This is because when the number of the units exceeds 3, the hydrophilicity of the developer system itself increases, resulting in an excessive increase of the electric conductivity of the carrier liquid.

Specific examples of the ether compounds useful in the present invention are the following glycol diethers.

Ethylene glycol diethers include ethylene glycol dipropyl ether, ethylene glycol dibutyl ether, ethylene glycol dipentyl ether, ethylene glycol dihexyl ether, ethylene glycol diheptyl ether, ethylene glycol dioctyl ether, ethylene glycol dinonyl ether, ethylene glycol didecyl ether, ethylene glycol diphenyl ether, ethylene glycol ditolyl ether, ethylene glycol dixylyl ether, ethylene glycol dinaphthyl ether, ethylene glycol dibenzyl ether, ethylene glycol butylhexyl ether, ethylene glycol 2-ethylhexylamyl ether and the like.

Diethylene glycol ethers include diethylene glycol dipropyl ether, diethylene glycol dibutyl ether, diethylene glycol dipentyl ether, diethylene glycol dihexyl ether, diethylene glycol diheptyl ether, diethylene glycol dioctyl ether, diethylene glycol dinonyl ether, diethylene glycol didecyl ether, diethylene glycol diphenyl ether, diethylene glycol ditolyl ether, diethylene glycol dixylyl ether, diethylene glycol dinaphthyl ether, diethylene glycol dibenzyl ether, diethylene glycol butylhexyl ether, diethylene glycol 2-ethylhexylamyl ether and the like.

Similar triethylene glycol diethers may also be used.

Propylene glycol diethers include propylene glycol dipropyl ether, propylene glycol dibutyl ether, propylene glycol dipentyl ether, propylene glycol dihexyl ether, propylene glycol diheptyl ether, propylene glycol dioctyl ether, propylene glycol dinonyl ether, propylene glycol didecyl ether, propylene glycol diphenyl ether, propylene glycol ditolyl ether, propylene glycol dixylyl ether, propylene glycol dinaphthyl ether, propylene glycol dibenzyl ether, propylene glycol butylhexyl ether, propylene glycol 2-ethylhexylamyl ether and the like.

Dipropylene glycol diethers include dipropylene glycol dipropyl ether, dipropylene glycol dibutyl ether, dipropylene glycol dipentyl ether, dipropylene glycol dihexyl ether, dipropylene glycol diheptyl ether, dipropylene glycol dioctyl ether, dipropylene glycol dinonyl ether, dipropylene glycol didecyl ether, dipropylene glycol diphenyl ether, dipropylene glycol ditolyl ether, dipropylene glycol dixylyl ether, dipropylene glycol dinaphthyl ether, dipropylene glycol dibenzyl ether, dipropylene glycol butylhexyl ether, dipropylene glycol 2-ethylhexylamyl ether and the like.

Similar tripropylene glycol diethers may also be used.

The glycol diethers of the invention may be used singly or in combination with known carrier liquids. Examples of such known carrier liquids include branched aliphatic hydrocarbons commercially available under the designations of Isoper H, G, L, M, V and the like from Ekson Chem., Co., Ltd., and linear aliphatic hydrocarbons commercially available under the designations of Norper 14, 15, 16 and the like from Ekson Chem. Co., Ltd.

Alternatively, waxy hydrocarbons having a relatively great molecular weight may also be used in combination, including n-undecane, n-dodecane, n-tridecane, n-tetradecane, n-pentadecane, n-hexadecane, n-heptadecane, n-octadecane, n-nonadecane and the like, and halogenated hydrocarbons thereof such as fluorocarbons. Still alternatively, silicone oils and modified silicone compounds may also be used for this purpose.

The ether compounds of the invention can lower the vapor pressure of a liquid developer when mixed only in small amounts and can also lower the freezing point of paraffinic hydrocarbons having a relatively great molecular weight to an extent of from the neighborhood of room temperature to a range where no practical problem is involved. Additionally, the ether compounds are effective in improving charge characteristics.

The amount of the ether compounds of the invention in the carrier liquid is generally in the range of from 5 to 100 wt %. If the amount is less than 5 wt %, they do not satisfactorily serve to lower the freezing point of high molecular weight aliphatic hydrocarbons to be used in combination, or to lower the vapor pressure of paraffinic oils having a low molecular weight.

The carrier liquid of the invention should preferably have an electric resistivity as high as not lower than $10^{10}$ Ω·cm. If the resistivity is lower than $10^{10}$ Ω·cm, charge on an electrostatic image carrier may be liable to leak.

The resins for the toner used din the present invention may be polyolefins such as polyethylene, polypropylene and the like. Preferably, ethylene copolymers having polar groups are used including, for example, copolymers of an α,β-ethylenically unsaturated acid selected from the group consisting of acrylic acid and methacrylic acid or its ester and ethylene, or ionomers of the copolymers which are ionically crosslinked. The process of preparing the copolymers of the type mentioned above is described in U.S. Pat. No. 3,264,272, issued to Ree, which is incorporated herein by reference.

Alternatively, there may be used homopolymers of styrenes such as styrene, o, m, p-methylstyrene, α-methylstyrene, p-ethylstyrene, 2,4-dimethylstyrene and the like, styrene-acrylate copolymers, or homopolymers or multi-component copolymers of other monomers.

The acrylate components of the styrene-acrylate copolymers include, for example, methyl acrylate, ethyl acrylate, propyl acrylate, n-butyl acrylate, iso-butyl acryiate, n-octyl acrylate, 2-ethylhexyl acrylate, lauryl acrylate, stearyl acrylate, 2-chloroethyl acrylate, phenyl acrylate and the like. Likewise, there may be used, instead of the acrylate component, methacrylates, α-methylene monocarboxylic esters such as dimethylaminoethyl methacrylate, diethylaminoethyl methacrylate and the like, betaine compounds of methacrylic acid and ammonium compounds thereof, and the like.

Moreover, there may be used homopolymers of the above-indicated acrylates, homopolymers or copolymers with other monomers of perfluorooctyl (meth)acrylate, vinyl toluenesulfonic acid and its sodium acid, and vinyl pyridines and pyridinium salts thereof, polyamide resins based on dimer acids, and copolymers of dienes such as butadiene, isoprene and the like and vinyl monomers. In addition, polyesters and polyurethanes may be further used singly or in combination with the resins set out above.

In the practice of the invention, the colorants which are dispersed in the resin may be any known organic or inorganic pigments or dyes. For instance, there may be mentioned C.I. Pigment Red 48:1, C.I. Pigment Red 57:1, C.I. Pigment Red 122, C.I. Pigment Red 17, C.I. Pigment Yellow 97, C.I. Pigment Yellow 12, C.I. Pigment Blue 15:1, C.I. Pigment Blue 15:3, Lamp Black (C.I. No. 77266), Rose Bengal (C.I. No. 45432), carbon black, Nigrosine dye (C.I. No. 50415B), and mixtures thereof. Further, there may also be used metal oxides such as silica, aluminium oxide, magnetite, various ferrites, cupric oxide, nickel oxide, zinc oxide, zirconium oxide, titanium oxide, magnesium oxide and mixtures thereof.

These colorants should be contained in the toner particles in an amount sufficient to form a visible image. Although depending on the toner particle size and the amount used for development, the amount is usually in the range of from 1 to 100 parts by weight per 100 parts by weight of the resin.

For the preparation of the toner particles and the liquid developer, any known processes may be used. For instance, toners may be prepared according to the process set forth in the afore-indicated references of Metcalfe and various processes set out in Japanese Laid-open Patent Application Nos. 58-129438 and 58-152258 and also in U.S. Pat. No. 4,794,651, to B. Landa et al, (issued on Dec. 27, 1988).

For example, there is used a process which makes use of an appropriate device wherein the starting materials including the above-indicated resin, colorant and carrier liquid are dispersed and kneaded at temperatures at which the resin is plasticizable and the carrier liquid is not boiled, and which are lower than the decomposition temperature of the resin and/or colorant. More particularly, while utilizing the temperature dependence on the solubility of the resin in solvent, the resin and colorant are thermally melted in the carrier liquid by use of a planetary mixer or a kneader. The resultant melt is cooled under agitation to solidify and settle toner particles, thereby obtain a toner.

In another process, the starting materials are placed in an appropriate container, such as an attritor or a heating vibration mill, e.g. a heating ball mill, into which granular media used for dispersion and kneading are charged. The container is kept at a preferable temperature ranging, for example, from 80° to 160° C., by which the materials are dispersed and kneaded. Examples of the granular media are those of steels such as stainless steels, carbon steels and the like, alumina, zirconia, silica and the like.

For the preparation of a toner according to the above process, the starting materials which have become fluid are dispersed in the container by means of the granular media. Thereafter, while circulating cooling water or a coolant through an outer cooling jacket, the carrier liquid is cooled so that the resin containing the colorant therein is settled from the carrier liquid. It is important that the granular media be continuedly kept as dispersed during the course of and after the cooling, by which the toner particles are exerted with shear and/or impact forces from the media thereby rendering the particles finer in size.

The finely divided toner obtained by the above processes should preferably have a volume mean size of not larger than 10 μm, more preferably not larger than 5 μm, when determined using a centrifugal settlement-type size distribution measuring device. If necessary, the particles may be shaped to have a configuration having a number of fibers thereon. The term "configuration having a number of fibers thereon" means toner particles which are shaped as having fibrous extensions, cirri and/or tentacles on the surfaces thereof.

Another procedure of preparing a liquid developer comprises weighing a resin and a colorant at a given mixing ratio, thermally melting the resin, adding the colorant to the melt for dispersion and mixing, cooling the mixture, and dividing it by a mill such as a jet mill, a hammer mill, a turbo mill or the like to obtain fine particles. The thus obtained toner particles are dispersed in a carrier liquid.

Alternatively, toners may be prepared by polymerization processes such as suspension polymerization, emulsion polymerization, dispersion polymerization and the like, or by coacervation, melt dispersion, emulsion coagulation and the like techniques, followed by dispersion in carrier liquids to obtain liquid developers.

For the purposes of retaining the charge polarity of toner particles and uniformizing and stabilizing the charge quantity, charge control agents may be added to the carrier liquid or toner particles. The charge control agents may be those agents ordinarily used in wet developers and include lecithin, Basic Barium Petronate, Basic Sodium Petronate and Basic Calcium Petronate available from Vitoco Chemical Corp., oil-soluble petroleum sulfonate, alkylsuccinimides, and metallic soaps such as sodium dioctylsulfosuccinate, zirconium octanoate and the like. Besides, ionic and nonionic surface active agents, organic or inorganic salts such as quaternary ammonium salts, organic borates and metal-containing dyes, and block or graft copolymers having oleophilic and hydrophilic moieties may also be used.

Aside from the charge control agent, in order to control the physical properties of the developer, fine particles of polymers or inorganic fine particles may be further dispersed, or various additives may be dispersed or dissolved in the liquid developer.

The present invention is more particularly described by way of examples which should not be construed as limiting the invention thereto. Comparative examples are also described.

EXAMPLE 1

Copolymer of ethylene (89%)-methacrylic acid (11%) (New Krel N699 of Du Pont de Nemours) 40 parts by wt.

Copper phthalocyanine pigment (Cyanine Blue-4933M of Dainichiseika Colour & Chemicals Mfg. Co., Ltd.) 4 parts by wt. Isoper L 100 parts by wt.

The above formulation expect for Isoper L was charged into a stainless steel beaker and agitated for one hour while heating on an oil bath at 120° C., thereby obtaining a uniform melt of the resin and the pigment which had been completely melted. The resultant melt was gradually cooled down to rom temperature while agitating, to which 100 parts by weight of Isoper L was added. As the temperature of the mixture was lowered, toner particles each having the pigment included therein and having a size of 10 to 20 μm started to settle.

100 g of the thus settled toner was charged into a 01 type attritor (Mitsui-Miike Co., Ltd.) and finely divided at a revolution speed of the rotor of 300 rpm for about 20 hours by use of steel balls with a diameter of 0.8 mm. The division was continued until the size reached 2.5 μm while monitoring a volume mean size according to a centrifugal settling-type size distributor measuring instrument (CAPA500 of Shimadzu Corporation). The resultant toner concentrate was provided as a base toner.

20 parts by weight of the base toner (toner concentration of 18 wt %) was diluted with 160 parts by weight of diethylene glycol dibutyl ether so that the toner concentration was 2 wt %, followed by sufficient agitation. Moreover, Basic Barium Petronate provided as a charge director was added to the resultant liquid developer in an amount of 0.1 parts by weight per unit part by weight of the solid matter in the liquid developer, followed by sufficient agitation to obtain a liquid developer.

EXAMPLE 2

20 wt % of the base toner obtained in Example 1 was diluted with 160 parts by weight of ethylene glycol amylhexyl ether so that the solid content was made 2 wt %, followed by sufficient agitation. Basic Sodium Petronate provided as a charge director was added to the resultant liquid developer in the same amount as in Example 1, followed by sufficient agitation to obtain a liquid developer.

EXAMPLE 3

Polyester resin (obtained by polymerization of terephthalic acid and ethylene oxide-added hisphenol A with a weight average molecular weight, Mw=12000, an acid value of 5 and a softening point of 110° C.) 85 parts by weight Magenta pigment (Carmin 6B of Dainichiseika Colour & Chemicals Mfg. Co., Ltd.) 4 parts by weight The above formulation was kneaded in an extruder and finely divided by means of a jet mill, followed by classification with an air classifier to obtain toner particles having an average size of 3 μm.

This powder toner was dispersed in ethylene glycol dihexyl ether to make a solid content of 2 wt %. Then, Basic Calcium Petronate provided as a charge director was added to the liquid developer in the same amount as in Example 1, followed by sufficient agitation.

EXAMPLE 4

The general procedure of Example 1 was repeated using Pigment Yellow 17 as the pigment, thereby obtaining a toner concentrate. The toner had a particle size of 2.5 μm.

20 wt % of the toner concentrate (toner concentration of 18 wt %) was diluted with 160 parts by weight of diethylene glycol dibutyl ether to make a solid content of 2 wt %, followed by sufficient agitation. Sodium dioctylsulfosuccinate provided as a charge director was added in the same amount as in Example 1, followed by sufficient agitation to obtain a liquid developer.

EXAMPLE 5

Copolymer of ethylene (85%)-methacrylic acid (10%)-octyl methacrylate (5%) 40 parts by weight Pigment Yellow 17 (Dainichiseika Colour & Chemicals Mfg. Co., Ltd.) 4 parts by weight Isoper L 100 parts by weight The above formulation was treated in the same manner as in Example 1 to obtain a base toner. 20 parts by weight of the base toner (toner concentration of 18 wt %) was diluted with 160 parts by weight of diethylene glycol dibutyl ether to make a solid content of 2 wt %, followed by sufficient agitation. Thereafter, a liquid developer was prepared in the same manner as in Example 1.

EXAMPLE 6

The base toner obtained in Example 1 was diluted with propylene glycol dihexyl ether so that the solid content was made 2 wt %, thereby obtaining a liquid developer. No charge director was added in this example.

EXAMPLE 7

The general procedure of Example 1 was repeated using carbon black (Regal 330 of Cabot) as the pigment, thereby obtaining a liquid developer. The toner had a particle size of 2.5 μm.

COMPARATIVE EXAMPLE 1

The general procedure of Example 1 was repeated except that the base toner obtained in Example 1 was diluted with Isoper L to have a solid content of 2 wt %, thereby obtaining a liquid developer.

COMPARATIVE EXAMPLE 2

The base toner obtained in Example 1 was diluted with Isoper H to have a solid content of 2 wt %, followed by sufficient agitation. Soybean lecithin was added, as a charge director, to the resultant liquid developer in the same amount as in Example 1, followed by sufficient agitation to obtain a liquid developer.

Assessment Tests of Liquid Developer

A. Measurement of evaporation rate of carrier liquid 3 g of a carrier liquid was charged into a laboratory dish with an opening diameter of 50 mm. The dish was allowed to stand on a hot plate at 40° C. to measure a variation in evaporation rate in relation to time by means of a precision balance. The evaporation rate was determined according to the following equation. Evaporation rate (%) 100 ×the weight (g) of evaporated carrier liquid after 6 hours/3

B. Measurement of amounts of positive polarity toner and negative polarity toner in developer 3 ml of a liquid developer was placed between two parallel disk electrodes each of which had a diameter of 10 cm and an area of about 78 $cm^2$ and which were provided at a distance of 1 mm from each other. A potential of 1000 V was applied to the liquid developer for one second so that the electric field was $+10^4$ V/cm. Thereafter, the electrodes deposited with the toner were placed in a vacuum dryer and dried at 120° C. for 2 hours to completely eliminate the carrier liquid therefrom. The amount of the developed positive polarity toner was determined from the difference between the weights of the electrodes prior to and after the deposition. The above procedure was repeated except that the polarity of the applied potential was changed (i.e. electric field: $-10^4$ V/cm), thereby determining the amount of the negative polarity toner. The sole figure shows a circuit diagram of a toner charge quantity measurement device used in the above procedure. In the figure, the shaded portion is a liquid developer placed between the disk electrodes.

Moreover, a freezing point of carrier liquids was determined by a simple procedure wherein carrier liquids were allowed to stand at temperatures of 20° C., 0° C., −10° C. and −20° C., respectively, to judge a temperature at which the respective liquids were solidified. The solidification temperature was determined as the freezing point.

The compositions of the liquid developers and the results of the assessment tests are shown in Tables 1 and 2.

TABLE 1

| | Toner Composition | | | Carrier Composition |
|---|---|---|---|---|
| | Toner Resin | Pigment | Charge Director | Carrier Liquid |
| Ex. 1 | copolymer of ethylene-methacrylic acid | copper phthalo-cyanine | basic barium petronate (BBP) | diethylene glycol dibutyl ether |
| Ex. 2 | copolymer of ethylene-methacrylic acid | copper phthalo-cyanine | basic sodium petronate (BBP) | ethylene glycol amylhexyl ether |
| Ex. 3 | polyester resin | Carmin 6B | basic calcium petronate (BCP) | ethylene glycol dihexyl ether |
| Ex. 4 | copolymer of ethylene-methacrylic acid | Pigment Yellow 17 | sodium dioctyl-sulfo-succinate | diethylene glycol dibutyl ether |
| Ex. 5 | copolymer of ethylene-methacrylic acid-octyl methacrylate | Pigment Yellow 17 | basic barium petronate (BBP) | diethylene glycol dibutyl ether |
| Ex. 6 | copolymer of ethylene-methacrylic acid | copper phthalo-cyanine | nil | dipropyleneglycol dihexyl ether |
| Ex. 7 | copolymer of ethylene-methacrylic acid | carbon | basic barium petronate (BBP) | diethylene glycol dibutyl ether |
| Comp. Ex. 1 | copolymer of ethylene-methacrylic acid | copper phthalo-cyanine | basic barium petronate (BBP) | Isoper L |
| Comp. Ex. 2 | copolymer of ethylene-methacrylic acid | Carmin 6B | soybean lecithin | Isoper H |

TABLE 2

| | Evaporation Rate of Carrier Liquid (%) | Charge Polarity of Toner | Amount of Positive Polarity Toner (mg) | | Amount of Negative Polarity Toner (mg) | |
|---|---|---|---|---|---|---|
| | | | Immediately after Preparation of Developer | 7 Days after Preparation of Developer | Immediately after Preparation of Developer | 7 Days after Preparation of Developer |
| Ex. 1 | 4.6 | negative | 21.3 | 22.0 | 0.0 | 0.0 |
| Ex. 2 | 3.9 | negative | 20.5 | 21.0 | 0.1 | 0.1 |
| Ex. 3 | 3.3 | negative | 21.0 | 21.5 | 0.0 | 0.1 |
| Ex. 4 | 4.6 | positive | 21.8 | 22.0 | 0.0 | 0.1 |
| Ex. 5 | 4.6 | negative | 20.7 | 21.0 | 0.0 | 0.0 |
| Ex. 6 | 3.4 | positive | 21.5 | 22.0 | 0.0 | 0.0 |
| Ex. 7 | 4.6 | negative | 21.5 | 22.0 | 0.0 | 0.0 |
| Comp. Ex. 1 | 92 | negative | 10.5 | 10.1 | 1.9 | 3.4 |
| Comp. Ex. 2 | 99 | negative | 10.1 | 9.8 | 2.0 | 3.1 |

As will be apparent from Table 2, with the ether compounds of Examples 1 to 7 used as the carrier liquid, the evaporation rate is significantly lowered by 1/20 to 1/30 of those of Comparative Examples 1 and 2.

The developers of Examples 1, 2, 3, 5 and 7 exhibit good negative charging toner characteristics in view of the reduced amount of the negative polarity toner and are stabilized seven days after the preparation with respect to the amount of development. The developers of Examples 4 6 are also small in the amount of the negative polarity toner and exhibit stable positive charging toner characteristics in relation to the time. On the other hand, with Comparative Examples 1, 2, the developing amount of the developers is reduced by not larger than about half of those of Examples 1 to 7, with the amount of the negative polarity toner being too large.

EXAMPLE 8

The base toner obtained in Example 1 was diluted with a carrier liquid which consisted of a mixture of equal amounts by weight of diethylene glycol dibutyl ether and Norper 15 thereby making a solid content of 2 wt %, followed by the procedure of Example 1 to obtain a liquid developer having a toner concentration of 2 wt %.

EXAMPLE 9

The base toner obtained in Example 1 was diluted with a carrier liquid which consisted of a mixture of equal amounts by weight of diethylene glycol dibutyl ether and Isoper L, thereby making a solid content of 2 wt %, followed by the procedure of Example 1 to obtain a liquid developer having a toner concentration of 2 wt %.

COMPARATIVE EXAMPLE 3

The base toner obtained in Example 1 was diluted with Norper 15 to make a solid content of 2 wt %, followed by the procedure of Example 1 to obtain a liquid developer having a toner concentration of 2 wt %.

The results of the measurements of the evaporation rate and the freezing point of the liquid developers obtained above are shown in Table 3 below.

TABLE 3

| | Composition of Carrier Liquid | Compositional Ratio (wt %) | Evaporation Rate of Carrier Liquid (%) | Freezing Point of Carrier Liquid |
|---|---|---|---|---|
| Ex. 8 | diethylene glycol dibutyl ether | 50 | 2.5 | <−10 |
| | Norper 15 | 50 | | |
| Ex. 9 | diethylene glycol dibutyl ether | 50 | 8.2 | <−20 |
| | Isoper L | 50 | | |
| Comp. Ex. 3 | Norper 15 | 100 | 2.1 | 0 |

As will be apparent from Table 3, the carrier liquid of Example 8 has an evaporation rate of 2.5% and a freezing point of lower than −10° C., thus being substantially free of any problem in practice. The evaporation rate of the carrier liquid of Example 9 is 8.2%, which is much lower than that of Comparative Example 3 using Isoper L alone.

On the other hand, the carrier liquid of Comparative Example 3 is 0° C. and will become waxy under environments of winter. Thus, such a liquid developer has to be heated on development.

EXAMPLE 10

The black color developing unit portion of the FX-5030 copying machine (Fuji-Xerox Co., Ltd.) was reconstructed for liquid development to evaluate a liquid developer of the invention through image reproduction.

The images obtained using the liquid developer of Example 2 had a good high resolution. Moreover, the liquid developer was used for continuous duplication of 100 copies. The image after the 100th copy was substantially the same as an initial one.

What is claimed is:

1. A liquid developer for use in electrostatic photography which comprises toner particles, each containing a resin and a colorant dispersed in a carrier liquid, said carrier liquid comprising at least one ether compound of the following general formula $$R_1—O(C_nH_{2n}O)_x—R_2$$

wherein $R_1$ and $R_2$ may be the same or different and represent an alkyl group or an aryl group, n is an integer of 2 or 3, and x is an integer of 1 to 3.

2. A liquid developer according to claim 1, wherein the total number of carbon atoms in the groups represented by $R_1$ and $R_2$ ranges from 6 to 20.

3. A liquid developer according to claim 1, wherein said carrier liquid consists essentially of said at least one ether compound.

4. A liquid developer according to claim 1, wherein said carrier liquid comprises not less than 5 wt % of said at least one ether compound.

5. A liquid developer according to claim 1, wherein said carrier liquid has an electric resistivity of not smaller than $10^{10}$ Ω·cm.

6. A liquid developer according to claim 1, further comprising a charge control agent in said carrier liquid or in said toner particles.

* * * * *